US005254272A

United States Patent [19]

Walters et al.

[11] Patent Number: 5,254,272

[45] Date of Patent: Oct. 19, 1993

[54] LUBRICANT COMPOSITIONS WITH METAL-FREE ANTIWEAR OR LOAD-CARRYING ADDITIVES AND AMINO SUCCINATE ESTERS

[75] Inventors: David K. Walters, Camberley, England; Arthur S. Thomas, Swansea, Wales

[73] Assignee: Ethyl Petroleum Additives Limited, Bracknell, England

[21] Appl. No.: 970,549

[22] Filed: Nov. 2, 1992

Related U.S. Application Data

[63] Continuation of Ser. No. 633,776, Dec. 26, 1990, abandoned.

[30] Foreign Application Priority Data

Dec. 22, 1989 [GB] United Kingdom ..... 8929096

[51] Int. Cl.[5] ..... C10M 137/08; C10M 133/16

[52] U.S. Cl. ..... 252/32.7 E; 252/32.7 R; 252/34; 252/51.5 R; 252/51.5 A

[58] Field of Search ..... 252/51.5 A, 51.5 R, 252/34, 33.6, 32.7 R, 32.7 E

[56] References Cited

U.S. PATENT DOCUMENTS

| | | | |
|---|---|---|---|
| 4,056,531 | 11/1977 | Malec | 252/34 |
| 4,116,877 | 9/1978 | Outten et al. | 252/72 |
| 4,462,918 | 7/1984 | Matthews et al. | 252/51.5 R |

FOREIGN PATENT DOCUMENTS

| | | |
|---|---|---|
| 0086513 | 8/1983 | European Pat. Off. . |
| 1542113 | 3/1979 | United Kingdom . |
| 8707637 | 12/1987 | World Int. Prop. O. . |
| 8707638 | 12/1987 | World Int. Prop. O. . |

OTHER PUBLICATIONS

Smalheer & Smith, Lubricant Additives, 1967.

*Primary Examiner*—Ellen M. McAvoy
*Attorney, Agent, or Firm*—John F. Sieberth

[57] ABSTRACT

Lubricant compositions especially useful as hydraulic fluids contain a metal-free anti-wear or load-carrying additive containing sulphur and/or phosphorus and an amino succinate ester as corrosion inhibitor. Such compositions are free from heavy metal and have improved environmental acceptability where heavy metals are to be avoided, e.g. in agriculture. The lubricant base stock may be a biodegradable natural oil.

40 Claims, No Drawings

LUBRICANT COMPOSITIONS WITH METAL-FREE ANTIWEAR OR LOAD-CARRYING ADDITIVES AND AMINO SUCCINATE ESTERS

This is a continuation of copending application Ser. No. 07/633,776 filed on Dec. 26, 1990, now abandoned.

This invention relates to lubricant compositions, and more especially to lubricant compositions which can be used as hydraulic fluids.

Lubricant compositions normally contain a variety of additives incorporated to improve the performance of the lubricant in the environment in which it is to be used. Such additives often contain transition metals. As is well known, there is now a general need, for environmental reasons, to reduce the use of transition metals which are frequently toxic. For example, lubricants used as hydraulic fluids often contain, as an anti-wear additive, a zinc dialkyl dithiophosphate (a so-called "ZDDP"). It is desirable to be able to provide hydraulic fluids which are zinc free. This is especially true where the hydraulic fluid is to be used in agriculture or arboriculture where spillage of the fluid onto cultivated land may occur and cause pollution of the land and of any drainage or river system connected with it.

It is also desirable on practical grounds to be able to provide an additive system which is suitable for use in all types of hydraulic fluid irrespective of the particular equipment in which it will be used. A universal anti-wear (UAW) additive system for use in such hydraulic fluids must be capable of providing fluids capable of meeting the specifications of the leading hydraulic pump manufacturers, e.g. the Haglunds-Denison HFO specification and the Vickers Vane pump specification. It is a further requirement for such fluids that they must meet higher than load stage 10 performance in the FZG test described in more detail below. Hydraulic fluids incorporating ZDDPs do not always give the required performance in the FZG test.

There is therefore a need for a metal-free universal anti-wear additive system suitable for use in lubricant compositions to be used in, for example, piston and screw compressors, industrial gear systems, and, more particularly, in hydraulic fluids.

According to the present invention, a lubricant composition comprises (a) a metal-free anti-wear or load carrying additive containing sulphur and/or phosphorus, and (b) a corrosion inhibitor in the form of an amino succinate ester of formula

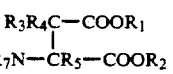

in which $R_1$ and $R_2$ are each alkyl of 1 to 30, preferably 1 to, 12, carbon atoms, $R_3$, $R_4$ and $R_5$ are each hydrogen or alkyl of 1 to 4 carbon atoms, and $R_6$ and $R_7$ are each hydrogen, alkyl of 1 to 30 carbon atoms, or an acyl group derived from a saturated or unsaturated carboxylic acid of up to 30 carbon atoms, at least one of $R_6$ and $R_7$ being a said acyl group Preferably $R_1$ and $R_2$ are each alkyl of 3 to 6 carbon atoms, e.g. isobutyl, $R_3$, $R_4$ and $R_5$ are each hydrogen, and $R_6$ and $R_7$ are each alkyl of 15 to 20 carbon atoms or an acyl radical derived from a saturated or unsaturated dicarboxylic acid containing 4 to 10 carbon atoms, e.g. octadecyl, octadecenyl, or 3-carboxy-1-oxo-2-propenyl. An especially preferred component (b) is aspartic acid, N-(3-carboxy-1-oxo-2-propenyl)-N-octadecyl-bis (2-methylpropyl)ester.

The metal free, and preferably ashless, anti-wear or load carrying additive may be any one of a wide range of sulphur- and/or phosphorus-containing additives, for example a mono- and/or di-hydrocarbyl phosphate or phosphite wherein the hydrocarbyl radical is alkyl of up to 12 carbon atoms, e.g. n-butyl, iso-butyl, n-amyl, n-octyl, 2-ethylhexyl or n-dodecyl, or a mixture thereof, and amine salts of such phosphates and phosphites, for example with primary amines of 4 to 18 carbon atoms, e.g. n-butylamine, n-octylamine, tert-octyl primary amine, n-dodecylamine, the commercially available mixture of tertiary alkyl primary amines such as Primene 81R in which the tertiary alkyl radicals contain 12 to 14 carbon atoms each, n-octadecylamine, oleylamine, and also secondary and tertiary amines such as di-n-octylamine, and tri-n-octylamine.

Other metal-free anti-wear or load carrying additives which can be used in the compositions of the present invention are sulphurized hydrocarbyl phosphites such as mono- and di-hydrocarbyl thiophosphates wherein the hydrocarbyl radical may be aryl, e.g. phenyl, alkylaryl, e.g. alkylphenyl in which the alkyl contains up to 12 carbon atoms, arylalkyl, or aliphatic, e.g. alkyl of up to 12 carbon atoms. Examples of such sulphurized hydrocarbyl phosphites includes diphenylthiophosphate, dinonylphenyl thiophosphates, di-n-butyl thiophosphate, di-isobutyl thiophosphate and di-2-ethylhexyl thiophosphate. Amine salts of such thiophosphates may also be used.

The anti-wear or load-carrying additive may also be a tri-hydrocarbyl di-thiophosphate in which each hydrocarbyl group may be, for example, an aromatic, alkylaromatic, cycloaliphatic, or aliphatic radical as aforesaid, e.g. isopropyl, n-butyl, isobutyl, n-pentyl, n-hexyl, 2-ethylhexyl or n-dodecyl. The hydrocarbyl group may also be an alkenyl or cycloalkyl radical.

Other metal free antiwear or load carrying additives which can be used in the invention are sulphurized alkenes, e.g. sulphurized isobutene, containing, for example 42 to 48% by weight of sulphur or a sulphurized carboxylic acid or ester thereof in which the acid is, for example a fatty acid such as oleic or linoleic acid, e.g. a sulphurized vegetable oil or animal fat such as rape seed oil or lard oil.

Suitable commercially available sulphurised fatty ester materials of this type include Sulperm 10S (Keil Chemical) and Ep Oil GE10 (Hornett). These typically contain about 9.5% and about 8.5–9.5% sulphur, respectively.

Dialkylpolysulphides such as t-nonyl trisulphide or t-dodecyl pentasulphide can also be used as the anti-wear or load-carrying additive.

The sulphur or phosphorus containing anti-wear or load carrying additive is advantageously prepared in the way described in our British Patent Application No. 8829597.7. These anti-wear or load-carrying additives are amine salts of phosphorothioic acids of formula:

$$(RO)_2PSO^- \cdot HN^+ R_1R_2R_3$$

in which the radicals R are the same or different and each is a substituted or unsubstituted hydrocarbyl radical of up to 20 carbon atoms and $R_1$, $R_2$ and $R_3$ are each hydrogen or substituted or unsubstituted hydrocarbyl radicals of up to 22 carbon atoms, not more than 2 of $R_1$, $R_2$ and $R_3$ being hydrogen. When produced by the process of the aforesaid application, such salts have a purity of at least 95% and have little reactivity towards copper, and less than 3% of a phosphite of formula $(RO)_2POH$ in which R is as hereinbefore defined or amine salt thereof. Preferred such amine salts are those in which R is alkyl of 3 to 8 carbon atoms or phenyl and each of $R_1$, $R_2$ and $R_3$ is hydrogen or an alkyl, cycloalkyl or alkenyl radical of 4 to 22 carbon atoms, not more than 2 of $R_1$, $R_2$ and $R_3$ being hydrogen. Preferably R is phenyl, $R_1$ and $R_2$ are hydrogen, and $R_3$ is mixed $C_{12}$–$C_{14}$ tertiary alkyl.

Such amine salts are made by forming a mixture of sulphur and the amine in the liquid state, adding to the mixture a phosphite ester of formula $(RO)_2POH$ in an amount at least equivalent to the amount of sulphur under conditions such that the sulphur reacts with the ester but the reaction temperature does not rise above 130° C., and then continuing the reaction until the solid sulphur has substantially disappeared from the reaction mixture. The quantity of amine is adjusted if necessary so that the total quantity of amine is at least equivalent to the quantity of the phosphite ester.

Compatible mixtures of such anti-wear or load-carrying additives can, of course, also be used.

The proportions of components (a) and (b) in the lubricant compositions of the invention are preferably from 0.05% to 3%, preferably 0.1% to 1.5%, of the antiwear or load carrying additive and from 0.002% to 0.5%, preferably 0.05 to 0.25%, by weight of the corrosion inhibitor, such percentages being by weight based on the total weight of the lubricant composition.

The lubricant composition may include as the base fluid any mineral or non-mineral oil suitable for use as a lubricant, or more especially as a hydraulic fluid. Such base stocks include paraffinic lubricating oil base stocks of mineral origin, synthetic oils such as poly-alpha-olefins, e.g. hydrogenated polydecene, synthetic lubricant esters, such as dialkyl adipates and azelates (in which the alkyl groups typically have 1 to 20 carbon atoms each, e.g. dioctyl azelate, dinonyl adipate, or di-2-ethylhexylazelate) and oils of biological origin including more particularly lubricant vegetable oils such as rape seed oil, jojoba oil, cotton seed oil, peanut oil or palm oil.

It is a particular advantage of the invention that the combination of components (a) and (b) as set out above is compatible with a variety of oils of natural, especially vegetable, origin suitable for use as hydraulic fluids. Such natural oils are biodegradable, and in consequence the present invention makes it possible to provide an effective hydraulic fluid based on a biodegradable base stock such as rape seed oil or jojoba oil and incorporating additives which are free from heavy metals.

When it is to be used in an acidic environment, it can be desirable to incorporate in a lubricant composition of the present invention a third component, viz. (c) an alkaline earth metal alkylbenzene sulphonate, alkylnaphthalene sulphonate, petroleum sulphonate, alkylphenate, alkyl sulphurized phenate, or alkylsalicylate. This material is usually overbased and may also be sulphurized. A sulphurized overbased calcium alkylphenate in which the alkyl group is paranonyl, or a calcium dinonylnaphthalenesulphonate is preferably used. The proportion of such additional additive is usually in the range 0.005 to 0.50% based on the total weight of the composition. Such compositions are not ashless, but they do not contain heavy metals and thus achieve one of the major objectives of the present invention.

The lubricant compositions of the present invention may incorporate other additives conventionally used in lubricants, for example:

(i) Additional corrosion inhibitors, e.g. amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, and half esters of alkenyl succinic acids in which the alkenyl radical contains 8 to 24 carbon atoms with alcohols such as polyglycols.

(ii) Ashless dispersants, especially those made by reaction of a polyolefin maleic anhydride reaction product with a polyalkylene polyamine such as triethylene tetramine or tetraethylene pentamine. In such dispersants, the polyolefin is typically polyisobutene having a number average molecular weight of 900 to 1200.

In some circumstances, it may be advantageous to boronate such ashless dispersants. While boron is nonmetal, it is ash-forming and its use in the compositions of the invention is not preferred.

(iii) Antioxidants including, for example, phenolic antioxidants such as 2,6-di-tert-butylphenol, 2,6-di-tert-butyl-4-methylphenol, and 4,4'-methylenebis(2,6-di-tertbutyl-phenol), sulphurized phenolic antioxidants such as 4,4'-thobis(6-tert-butyl-o-cresol) and aromatic amines such as di(nonylphenyl)amine and octylated phenyl-alphanaphthylamine. Mixtures of phenolic antioxidants and aromatic amine antioxidants (e.g., ETHYL® Antioxidant 728 and/or 733 with Naugalube 438L) are preferred.

(iv) Copper deactivators, e.g. benzotriazole and its derivatives, thiadiazoles and their derivatives, or tricresyl phosphite.

(v) Demulsifying agents, more particularly, surfactants which are preferably ashless, e.g. non-ionic surfactants such as polyglycols.

(vi) Viscosity index improvers, e.g. poly(alkylmethacrylates) and olefin copolymers such as ethylene/propylene and styrene/isoprene copolymers, and dispersant viscosity index improvers such as copolymers of an alkylmethacrylate with N-vinylpyrrolidone and olefin copolymers grafted with nitrogen-containing monomers such as diallylformamide.

(vii) Pour point depressants such as poly(alkylmethacrylates).

(viii) Anti-foam agents, e.g. products based on silicones and poly(alkylacrylates).

All such additional ingredients must of course be compatible with components (a) and (b) but, subject to this, they are used in the usual proportions.

The compositions of the invention are conveniently supplied to the formulator of the finished lubricant composition in the form of an additive concentrate comprising the components (A) and (B) as aforesaid, alone or preferably with a relatively small amount of suitable base oil to facilitate handling, and optionally with one or more of the additional ingredients mentioned above. In such concentrates the amounts of components (A) and (B) are proportioned such that when the concentrate is blended into a base fluid to provide a finished lubricant composition in which the concentration of component (A) is from 0.05 to 3% by weight and preferably from 0.1 to 1.5% by weight based on the total weight of the lubricant composition, the concentration of component (B) is from 0.002 to 0.5% by weight and preferably from 0.05 to 0.25 % by weight based on the total weight of the lubricant composition. Thus the ratio of (A) to (B) in such concentrates is preferably 30:1 to 0.4:1. The proportion of component (B) in the concentrate is preferably from 0.1 to 50% by weight, especially 0.1 to 10%, and most commonly 1 to 5% by weight of the concentrate.

The following Examples illustrate the invention.

Hydraulic fluid blends were prepared using as the base stock an ISO 46 mineral base oil having a kinematic viscosity range at 40° C. of from 41.4 to 50.6 cSt. The additives incorporated were as stated below. Each blend was evaluated for clarity and by the IP 135B corrosion test. The latter test involves stirring a mixture of 300 ml of the hydraulic fluid with 30 ml of artificial sea water at a temperature of 60° C. with a steel cylinder immersed in the mixture. The test was run in duplicate for 24 hours with each blend and the immersed steel specimens were then examined for signs of rusting. For a pass, no rust must be visible on the specimen.

The blends were also examined by the FZG test (IP334/79). In this test two steel spur gears are rotated together with oil dip lubrication for a series of 15 minute stages. The relative torque between the gears is increased by a fixed amount after each stage and the gears are run together for a given period after which they are examined for wear or damage. The result of the test is quoted in terms of the final pass stage and the first fail stage. To be satisfactory, the pass stage must be higher than 10.

The following Tables I and II set out the compositions of the hydraulic fluids tested and the results obtained with each. Blend 4, 5, 6, 7 and 10 are in accordance with the present invention. The other blends are for comparison.

TABLE I

| | CONCENTRATIONS IN WT PERCENTAGE IN ISO 46 HYDRAULIC FLUID BASE OIL | | | | | |
|---|---|---|---|---|---|---|
| Blend | 1 | 2 | 3 | 4 | 5 | 6 |
| Component A1 | 0.07 | 0.07 | 0.07 | 0.07 | 0.07 | 0.1 |
| Component A2 | 0.19 | 0.19 | 0.19 | 0.19 | 0.19 | 0.12 |
| Component B | — | — | — | 0.02 | 0.02 | 0.015 |
| Corrosion Inhib. D | 0.065 | — | 0.04 | 0.03 | 0.025 | 0.025 |
| Corrosion Inhib. E | — | 0.02 | — | — | — | — |
| Corrosion Inhib. F | — | — | 0.075 | — | — | — |
| FZG Load Stage Fail | 12 Pass | 9 Pass/ 10 Fail | Not Tested | 12 Pass | 12 Pass | 12 Pass |
| IP 135 B Test Result | Fail Moderate Rust | Fail Severe Rust | Not Tested | Pass No rust | Pass No rust | Pass No rust |
| Clarity of Blended fluid | Clear | Clear | Cloudy | Clear | Clear | Clear |

Component A1 was the Primene 81R salt of diphenylthiophosphate.
Component A2 was a blend of 36% di-t-nonyl polysulphide and 64% sulphurised fatty ester
Component B was aspartic acid, N-(3 carboxy-2-oxo-2-propenyl)-N-octadecyl-bis(2-methylpropyl)ester.
Corrosion Inhibitor D was a condensation product of dodecenyl succinic acid and oleic acid with a polyethylene polyamine
Corrosion Inhibitor E was octylamine octanoate.
Corrosion Inhibitor F was a modified imidazoline (Monamulse CI)
Blends 1-6 contained the same levels of conventional antioxidant, copper deactivator and demulse aid.
Blends 2 and 5 additionally contained a boronated polyisobutenyl succinimide ashless dispersant in conventional amount. In blend 6, component A1 was prepared in the way described in British Patent Application 8829597.7

TABLE II

| | CONCENTRATIONS IN WT PERCENTAGE IN ISO 46 HYDRAULIC FLUID BASE OIL | | | |
|---|---|---|---|---|
| Blend | 7 | 8 | 9 | 10 |
| Component A1 | 0.07 | 0.07 | 0.07 | 0.07 |
| Component A2 | 0.19 | 0.19 | 0.19 | 0.19 |
| Component B | 0.04 | — | — | 0.02 |
| Detergent C | 0.04 (C1) | 0.04 (C1) | 0.04 (C1) | 0.0075 (C2) |
| Corrosion Inhib. F | — | 0.04 | — | — |

TABLE II-continued

| | CONCENTRATIONS IN WT PERCENTAGE IN ISO 46 HYDRAULIC FLUID BASE OIL | | | |
|---|---|---|---|---|
| Blend | 7 | 8 | 9 | 10 |
| Corrosion Inhib. G | — | — | 0.03 | — |
| Corrosion Inhib. D | 0.05 | 0.05 | 0.05 | 0.025 |
| Clarity of Blended Fluid | Clear | Cloudy | Hazy | Clear |
| IP135B Test Result | Pass | Pass | Pass | Pass |
| FZG Load Stage Fail | 11 Pass/ 12 Fail | 11 Pass/ 12 Fail | 11 Pass 12 Fail | 11 Pass/ 12 Fail |

Components A1, A2, B, D and F were as in Table I.
Detergent C1 was an overbased calcium sulphurised nonylphenate.
Detergent C2 was calcium dinonyl naphthalene sulphonate
Corrosion Inhibitor G was butanedioic acid, sulpho-1,4-tridecyl ester, sodium salt.
Blends 7, 8 and 9 contained the same levels of conventional antioxidant, copper deactivator, VI improver and demulse aid.
Blend 10 similar to blends 7 to 9 but contained a boronated polybutenyl succinimide ashless dispersant in conventional amount and no VI improver.

In a further experiment, a blend 11 was made having the same composition as blend 6 except that the base oil was rape seed oil. The results in the FZG test, the IP135B test, and the clarity of the blend were the same as those obtained with blend 6.

In another experiment, a blend 12 was made having the same composition as blend 6 except that component A1 was used at a concentration of 0.11 weight percent, and component A2 was composed entirely of the sulphurised fatty ester (Sulperm 10S). Blend 12 produced the same FZG, IP135B, and clarity results as blend 6. In performance testing, blend 12 met the requirements of the Haglunds-Denison HFO specification, the Cincinnati Milacron P68, P69 and P70 specifications, and the Vickers vane pump specification.

In yet another experiment, blend 13 was formed by blending the additive components of blend 12 in the same concentrations as blend 12 with rape seed oil. Blend 13 gave the same FZG, IP135B, and clarity results as blend 11. In further testing blend 13 was found to satisfy the pump test requirements of the Haglunds-Denison HFO specification, as well as the Cincinnati Milacron thermal stability test procedure "A". In this latter test procedure, a copper rod and an iron rod are kept in contact with each other under the surface of 200 milliliters of test oil in a beaker for 7 days at a constant temperature of 135° C. On completion of the test it was found that passing ratings were achieved relative to sludge formation, iron rod performance and weight change of the copper rod.

We claim:

1. A metal free lubricant composition comprising a major amount of oil of lubricating viscosity and minor amounts of (a) a metal-free anti-wear or load-carrying additive containing sulphur and/or phosphorus and (b) a corrosion inhibitor int he form of an amino succinate ester of formula $$\begin{array}{c} R_3R_4C-COOR_1 \\ | \\ R_6R_7N-CR_5-COOR_2 \end{array}$$

in which each of $R_1$ and $R_2$ is alkyl of 1 to 30 carbon atoms; each of $R_3$, $R_4$ and $R_5$ is selected from hydrogen and alkyl of 1 to 4 carbon atoms; and each of $R_6$ and $R_7$ is selected from hydrogen, alkyl of 1 to 30 carbon atoms, and an acyl group derived form a saturated or unsaturated carboxylic acid of up to 30 carbon atoms, at least one of $R_6$ and $R_7$ being a said acyl group.

2. A lubricant composition according to claim 1 in which, in the said amino succinate ester, $R_1$ and $R_2$ are each alkyl of 3 to 6 carbon atoms; $R_3$, $R_4$ and $R_5$ are each hydrogen; and each of $R_6$ and $R_7$ is selected from alkyl of 15 to 20 carbon atoms and an acyl radical derived from a saturated or unsaturated dicarboxylic acid containing 4 to 10 carbon atoms.

3. A lubricant composition according to claim 1 wherein the corrosion inhibitor is aspartic acid, N-(3-carboxy-1-oxo-2-propenyl)-N-octadecyl-bis(2-methylpropyl) ester.

4. A lubricant composition according to claim 1 wherein the metal-free anti-wear or load-carrying additive is a mono- and/or di-hydrocarbyl phosphate or phosphite wherein the hydrocarbyl radical is alkyl of up to 12 carbon atoms or an amine salt of such a phosphite or phosphate or a mixture thereof.

5. A lubricant composition according to claim 1 wherein the metal-free anti-wear or load-carrying additive is a mono- or di-hydrocarbyl thiophosphate wherein the hydrocarbyl radical is aryl, alkylaryl, arylalkyl, or alkyl, or an amine salt thereof.

6. A lubricant composition according to claim 5 wherein the metal-free anti-wear or load-carrying additive is at least one monothiophosphate selected from the group consisting of (i) diphenylthiophosphate, (ii) dinonylphenyl thiophosphate, (iii) di-n-butyl thiophosphate, (iv) diisobutyl thiophosphate, (v) di-2-ethylhexyl thiophosphate, and (vi) an amine slat of any of the foregoing.

7. A lubricant composition according to claim 1 wherein the metal-free anti-wear or load-carrying additive is a tri-hydrocarbyl dithiophosphate in which each hydrocarbyl group is an aromatic, alkylaromatic, cycloaliphatic, or aliphatic radical.

8. A lubricant composition according to claim 1 wherein the anti-wear or load-carrying additive is an amine salt of a phosphorothioic acid of formula:

$$(RO)_2PSO^- \cdot HN^+R_1R_2R_3$$

in which the radicals R are the same or different and each is a substituted or unsubstituted hydrocarbyl radical of up to 20 carbon atoms and $R_1$, $R_2$, and $R_3$ are each hydrogen or a substituted or unsubstituted hydrocarbyl radical of up to 22 carbon atoms, not more than 2 of $R_1$, $R_2$, and $R_3$ being hydrogen.

9. A lubricant composition according to claim 8 wherein R is alkyl of 3 to 8 carbon atoms or phenyl and each of $R_1$, $R_2$, and $R_3$ is hydrogen or an alkyl, cycloalkyl or alkenyl radical of 4 to 22 carbon atoms each, not more than two of $R_1$, $R_2$ and $R_3$ being hydrogen.

10. A lubricant composition according to claim 1 wherein the anti-wear or load-carrying additive is comprised of a combination of (i) at least one metal-free anti-wear or load-carrying additive containing phosphorus and (ii) at least one metal-free anti-wear or load-carrying additive containing sulphur.

11. A lubricant composition according to claim 1 wherein the anti-wear or load-carrying additive is comprised of a combination of (i) an oil soluble amine salt of a phosphorothioic acid of formula:

$$(RO)_2PSO^- \cdot HN^+R_1R_2R_3$$

in which the radicals R are the same or different and each is a substituted or unsubstituted hydrocarbyl radical of up to 20 carbon atoms and $R_1$, $R_2$, and $R_3$ are each hydrogen or a substituted or unsubstituted hydrocarbyl radical of up to 22 carbon atoms, not more than 2 of $R_1$, $R_2$, and $R_3$ being hydrogen; and (ii) a sulphurized fatty acid ester.

12. A lubricant composition according to claim 1 wherein the anti-wear or load-carrying additive is comprised of a combination of (i) an amine salt of a phosphorothioic acid of formula:

$$(RO)_2PSO^- \cdot HN^+R_1R_2R_3$$

in which the radicals R are phenyl, $R_1$ and $R_2$ are hydrogen and $R_3$ is mixed $C_{12}$–$C_{14}$ tertiary alkyl; (ii) sulphurized fatty acid ester and (iii) dialkyl polysulfide.

13. A lubricant composition according to claim 8 wherein the corrosion inhibitor is aspartic acid, N-(3-carboxy-1-oxo-2-propenyl)-N-octadecyl-bis(2-methylpropyl) ester.

14. A lubricant composition according to claim 10 wherein the corrosion inhibitor is aspartic acid, N-(3-carboxy-1-oxo-2-propenyl)-N-octadecyl-bis(2-methylpropyl) ester.

15. A lubricant composition according to claim 11 wherein the corrosion inhibitor is aspartic acid, N-(3-carboxy-1-oxo-2-propenyl)-N-octadecyl-bis(2-methylpropyl) ester.

16. A lubricant composition according to claim 12 wherein the corrosion inhibitor is aspartic acid, N-(3-carboxy-1-oxo-2-propenyl)-N-octadecyl-bis(2-methylpropyl) ester.

17. A lubricant composition according to claim 1 wherein the oil of lubricating viscosity is a paraffinic lubricating oil base stock of mineral origin, a synthetic poly-alpha-olefin, a synthetic lubricant ester or an oil of biological origin.

18. A lubricant composition according to claim 17 in which the oil is a biodegradable vegetable oil.

19. A lubricant composition according to claim 18 in which the vegetable oil is a rape seed oil.

20. A lubricant composition according to claim 1 containing 0.1 to 1.5% by weight of the anti-wear or load-carrying additive nd from 0.05 to 0.25% by weight of the corrosion inhibitor.

21. A lubricant composition according to claim 1 which contains also an ashless dispersant made by reacting a polyolefin-maleic anhydride reaction product with a polyalkylene polyamine.

22. A lubricant composition according to claim 10 which contains also an ashless dispersant made by reacting a polyolefin-maleic anhydride reaction product with a polyalkylene polyamine.

23. A lubricant composition according to claim 12 which contains also an ashless dispersant made by reacting a polyolefin-maleic anhydride reaction product with a polyalkylene polyamine.

24. A metal-free additive concentrate comprising (a) at least one metal-free anti-wear or load-carrying additive containing sulphur and/or phosphorus and (b) a corrosion inhibitor in the form of an amino succinate ester of formula

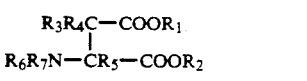

in which each of $R_1$ and $R_2$ is alkyl of 1 to 30 carbon atoms; each of $R_3$, $R_4$ and $R_5$ is selected from hydrogen and alkyl of 1 to 4 carbon atoms; and each of $R_6$ and $R_7$ is selected from hydrogen, alkyl of 1 to 30 carbon atoms, and an acyl group derived from a saturated or unsaturated carboxylic acid of up to 30 carbon atoms, at least one of $R_6$ and $R_7$ being a said acyl group.

25. An additive concentrate according to claim 24 wherein the metal-free anti-wear or load-carrying additive comprises an amine salt of a phosphorothioic acid of formula:

$$(RO)_2PSO^- \cdot HN^+R_1R_2R_3$$

in which the radicals R are the same or different and each is a substituted or unsubstituted hydrocarbyl radical of up to 20 carbon atoms and $R_1$, $R_2$, and $R_3$ are each hydrogen or a substituted or unsubstituted hydrocarbyl radical of up to 22 carbon atoms, not more than 2 of $R_1$, $R_2$, and $R_3$ being hydrogen.

26. An additive concentrate according to claim 24 wherein the metal-free anti-wear or load-carrying additive is comprised of a combination of (i) an amine salt of a phosphorothioic acid of formula:

$$(RO)_2PSO^- \cdot HN^+R_1R_2R_3$$

in which the radicals R are the same or different and each is a substituted or unsubstituted hydrocarbyl radical of up to 20 carbon atoms and $R_1$, $R_2$, and $R_3$ are each hydrogen or a substituted or unsubstituted hydrocarbyl radical of up to 22 carbon atoms, not more than 2 of $R_1$, $R_2$, and $R_3$ being hydrogen; and (ii) a sulphurized fatty acid ester.

27. An additive concentrate according to claim 24 wherein the metal-free anti-wear or load-carrying additive is comprised of a combination of (i) an amine salt of a phosphorothioic acid of formula:

$$(RO)_2PSO^- \cdot HN^+R_1R_2R_3$$

in which the radicals R are phenyl, $R_1$ and $R_2$ are hydrogen and $R_3$ is mixed $C_{12}$–$C_{14}$ tertiary alkyl; (ii) sulphurized fatty acid ester and (iii) dialkyl polysulfide.

28. An additive concentrate according to claim 25 wherein the corrosion inhibitor is aspartic acid, N-(3-carboxy-1-oxo-2-propenyl)-N-octadecyl-bis(2-methylpropyl) ester.

29. An additive concentrate according to claim 28 wherein the corrosion inhibitor is aspartic acid, N-(3-carboxy-1-oxo-2-propenyl)-N-octadecyl-bis(2-methylpropyl) ester.

30. An additive concentrate according to claim 24 in which, in the said amino succinate ester, $R_1$ and $R_2$ are each alkyl of 3 to 6 carbon atoms; $R_3$, $R_4$ and $R_5$ are each hydrogen; and each of $R_6$ and $R_7$ is selected form alkyl of 15 to 20 carbon atoms and an acyl radical derived from a saturated or unsaturated dicarboxylic acid containing 4 to 10 carbon atoms.

31. An additive concentrate according to claim 24 wherein the metal-free anti-wear or load-carrying additive is a mono- or di-hydrocarbyl thiophosphate wherein the hydrocarbyl radical is aryl, alkylaryl, arylalkyl, or alkyl, or an amine salt thereof.

32. An additive concentrate according to claim 21 wherein the metal-free anti-wear or load-carrying additive is at least one monothiophosphate selected form the group consisting of (i) diphenylthiophosphate, (ii) dinonylphenyl thiophosphate, (iii) di-n-butyl thiophosphate, (iv) di-isobutyl thiophosphate, (v) di-2-ethylhexyl thiophosphate, and (vi) an amine salt of any of the foregoing.

33. An additive concentrate according to claim 24 wherein the metal-free anti-wear or load-carrying additive is a trihydrocarbyl dithiophosphate in which each hydrocarbyl group is an aromatic, alkylaromatic, cycloaliphatic, or a aliphatic radical.

34. An additive concentrate according to claim 24 wherein the anti-wear or load-carrying additive is comprised of a combination of (i) at least one metal-free anti-wear or load-carrying additive containing phosphorus and (ii) at least one metal-free anti-wear or load-carrying additive containing sulphur.

35. An additive concentrate according to claim 24 wherein the corrosion inhibitor is aspartic acid, N-(3-carboxy-1-oxo-2-propenyl)-N-octadecyl-bis(2-methylpropyl) ester.

36. An additive concentrate according to claim 24 wherein the anti-wear or load-carrying additive is comprised of a combination of (i) an amine salt of a phosphorothioic acid of formula:

$$(RO)_2PSO^- \cdot HN^+R_1R_2R_3$$

in which the radicals R are phenyl, $R_1$ and $R_2$ are hydrogen and $R_3$ is mixed $C_{12}$–$C_{14}$ tertiary alkyl; (ii) sulphurized fatty acid ester and (iii) dialkyl polysulfide.

37. An additive concentrate according to claim 24 wherein the metal-free anti-wear or load-carrying additive is comprised of a combination of (i) an oil-soluble amine salt of a phosphorothioic acid of formula:

$$(RO)_2PSO^- \cdot HN^+R_1R_2R_3$$

in which the radicals R are the same or different and each is a substituted or unsubstituted hydrocarbyl radical of up to 20 carbon atoms and $R_1$, $R_2$, and $R_3$ are each hydrogen or a substituted or unsubstituted hydrocarbyl radical of up to 22 carbon atoms, not more than 2 of $R_1$, $R_2$, and $R_3$ being hydrogen; (ii) an oil-soluble sulphurized fatty acid ester; and (iii) an oil-soluble dialkyl polysulfide; and wherein, in the said amino succinate easter, $R_1$ and $R_2$ are each alkyl of 3 to 6 carbon atoms; $R_3$, $R_4$ and $R_5$ are each hydrogen; and each of $R_6$ an $R_7$ is selected form alkyl of 15 to 20 carbon atoms and an acyl radical derived form a saturated or unsaturated dicarboxylic acid containing 4 to 10 carbon atoms.

38. An additive concentrate according to claim 24 which contains also an ashless dispersant made by reacting a polyolefinmaleic anhydride reaction product with a polyalkylene polyamine.

39. An additive concentrate according to claim 34 which contains also an ashless dispersant made by reacting a polyolefinmaleic anhydride reaction product with a polyalkylene polyamine.

40. An additive concentrate according to claim 37 which contains also an ashless dispersant made by reacting a polyolefinmaleic anhydride reaction product with a polyalkylene polyamine.

* * * * *